US006843656B2

(12) United States Patent
Hwang et al.

(10) Patent No.: US 6,843,656 B2
(45) Date of Patent: Jan. 18, 2005

(54) OMNIDIRECTIONALLY ADJUSTABLE WALL LAMP PLUG

(76) Inventors: Cun Yu Hwang, 235 Chung-Ho Box 8-24, Taipei (TW); Li-Hong Zheng, 235 Chung-Ho Box 8-24, Taipei (TW)

( * ) Notice: Subject to any disclaimer, the term of this patent is extended or adjusted under 35 U.S.C. 154(b) by 80 days.

(21) Appl. No.: 10/670,850

(22) Filed: Sep. 26, 2003

(65) Prior Publication Data

US 2004/0058562 A1 Mar. 25, 2004

Related U.S. Application Data

(63) Continuation-in-part of application No. 09/852,640, filed on May 11, 2001, now abandoned.

(51) Int. Cl.[7] ..... H01R 39/00
(52) U.S. Cl. ..... 439/11; 439/13; 439/21
(58) Field of Search ..... 439/11–13, 18–23; 362/226, 287

(56) References Cited

U.S. PATENT DOCUMENTS 3,092,695 A * 6/1963 Abrams ..... 200/51 R
5,352,122 A * 10/1994 Speyer et al. ..... 439/13
5,683,254 A * 11/1997 Lin ..... 439/11
5,711,674 A * 1/1998 Chu ..... 439/11
5,954,519 A * 9/1999 Hsiao ..... 439/21
6,093,028 A * 7/2000 Yang ..... 439/13
6,488,510 B2 * 12/2002 Li ..... 439/13

* cited by examiner

*Primary Examiner*—Michael C. Zarroli

(57) ABSTRACT

An omnidirectionally adjustable wall lamp plug is disclosed. A conductor element has a vertical surface at the lateral side thereof. The conductor element is formed by bending from a body of the conductor element. A contact element has a vertical side at the lateral side thereof. The union end of one pin in the plug base resists against the vertical surface of the conductor element, and a buckling edge along each of the two sides of the union end is inserted into the plug base. A connection washer end is bent from one end of a small pin resists against the vertical surface of the conductor element. Thereby, when the wall lamp rotates through 360 degrees. The electric power is still supplied so as to achieve the object of omnidirectional adjustment.

2 Claims, 7 Drawing Sheets

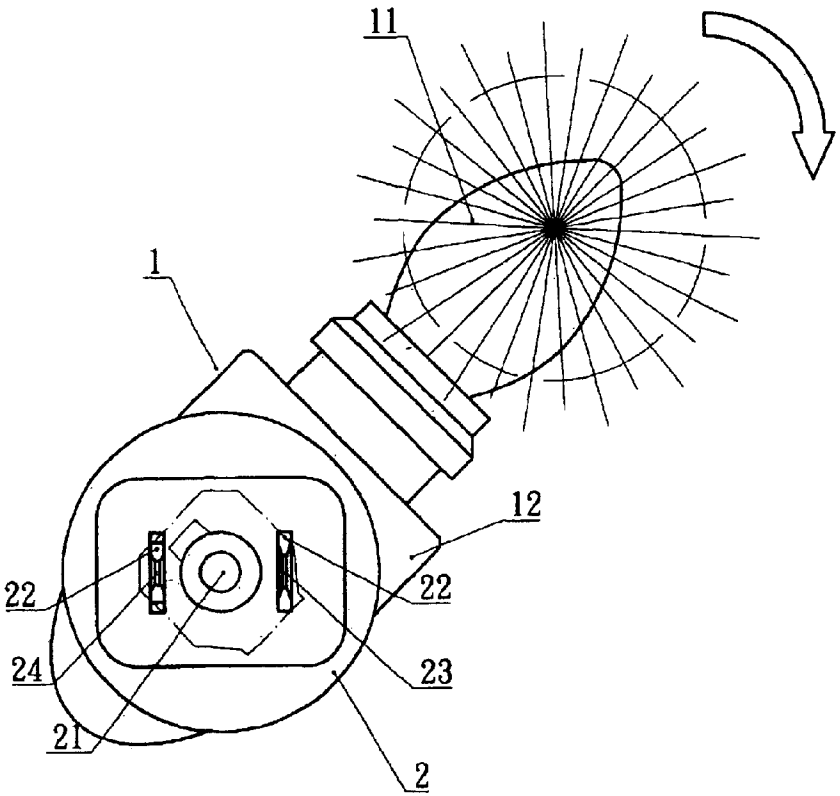
FIG4-B
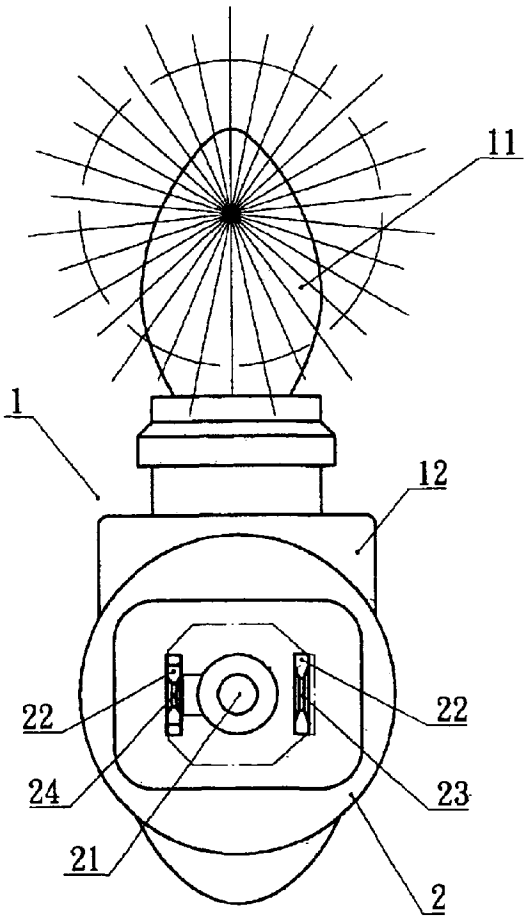
FIG4-A

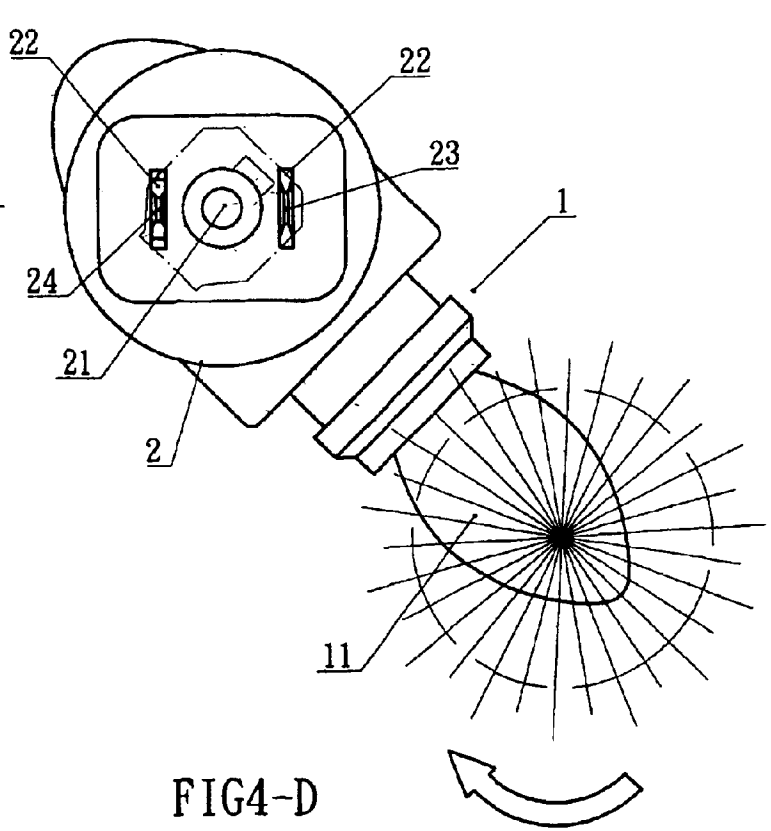
FIG4-D
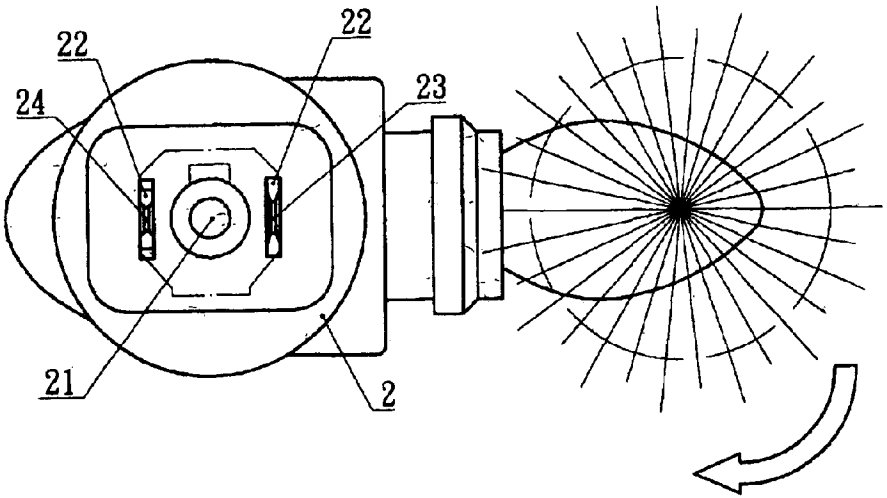
FIG4-C

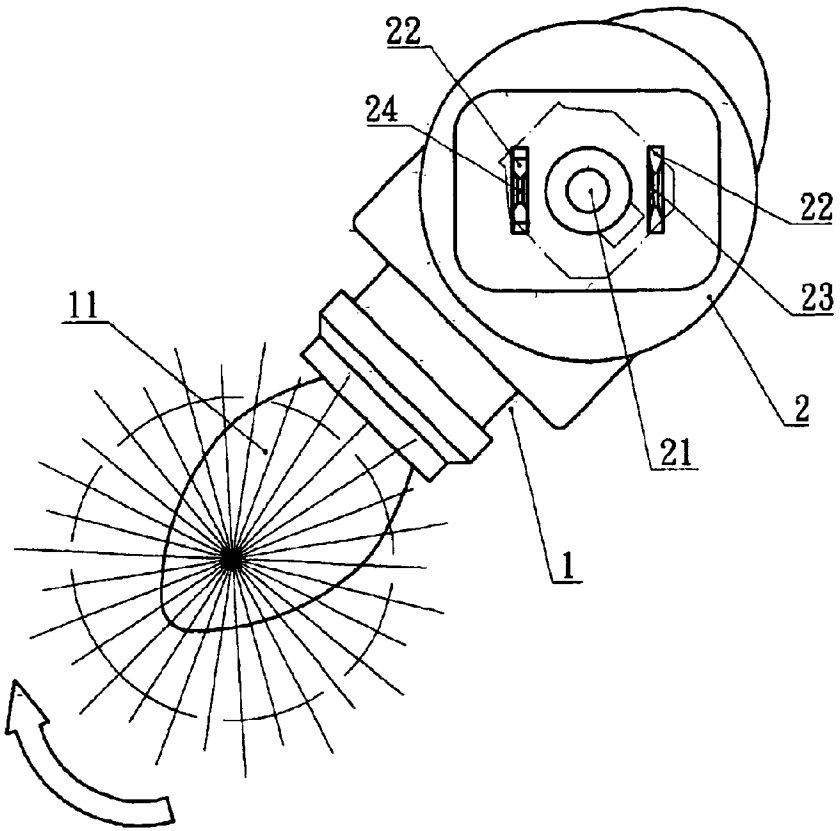
FIG4-F
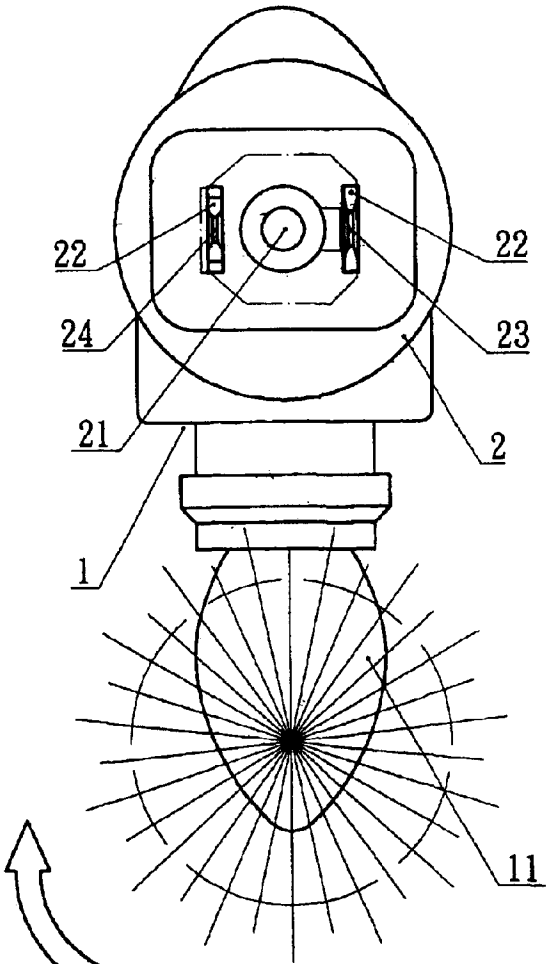
FIG4-E

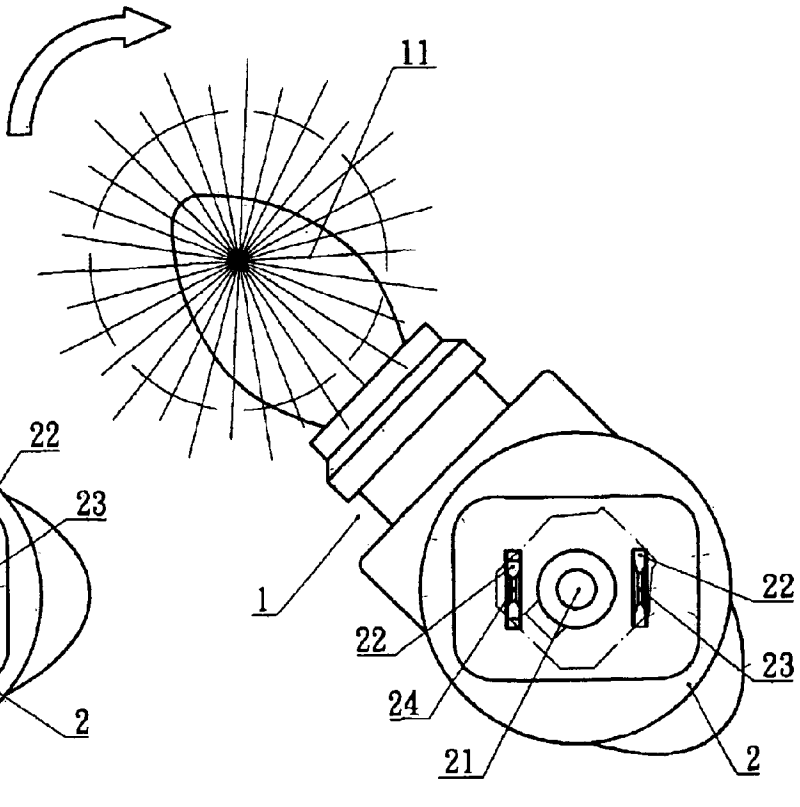
FIG4-H
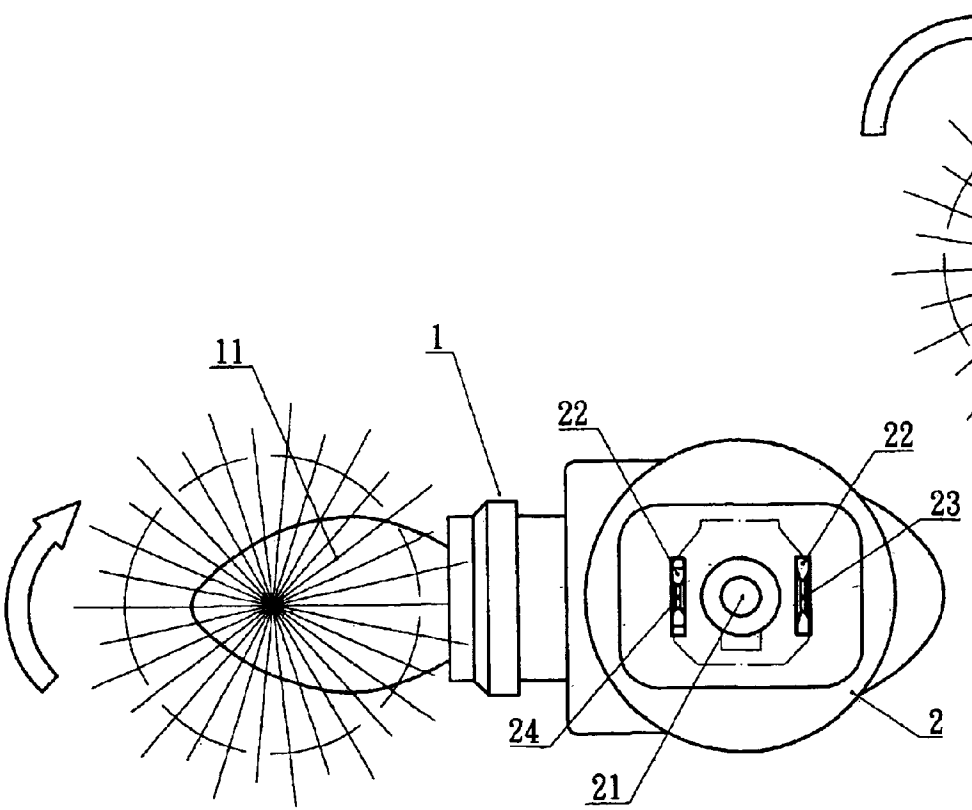
FIG4-G

OMNIDIRECTIONALLY ADJUSTABLE WALL LAMP PLUG

The present invention is a continuation in part of U.S. patent application Ser. No. 09/852,640 filed on May 11, 2001 now abandoned which is assigned to the inventor of the present invention, and thus the content of U.S. patent application Ser. No. 09/852,640 is incorporated into the present invention as a part of the specification.

BACKGROUND OF THE INVENTION

1) Field of the Invention

The present invention relates to lamp plugs, and particularly to an omnidirectionally adjustable wall lamp plug capable of rotating through 360-degrees for adjustment.

2) Description of the Prior Art

Referring to FIG. 1, a conventional wall lamp comprises a wall lamp body 10 and a plug base 101, which are formed integrally by mold injection. The wall lamp and the pins 102 arranged at a fixed orientation such that the wall lamp can only be plugged into a receptacle vertically or horizontally. Thereby, the orientation is not adjustable, otherwise the objects at two sides thereof will be shielded. To solve this problem, numerous patents about adjustable angle wall lamp plug structures are disclosed, such as U.S. Pat. Nos. 6,093,028; 5,711,674; 5,352,122; 5,954,519; and 5,683,254. Although these prior art structures are capable of adjusting the orientation, the structures are too complex to be assembled easily, resulting in the shortcomings of production cost and high malfunction rates.

SUMMARY OF THE INVENTION

Accordingly, the primary object of the present invention is to provide an omnidirectionally adjustable wall lamp plug. A conductor element has a vertical surface at the lateral side thereof. The conductor element is formed by bending from a body of the conductor element. A contact element has a vertical side at the lateral side thereof. The union end of one pin in the plug base resists against the vertical surface of the conductor element, and a buckling edge along each of the two sides of the union end is inserted into the plug base. A connection washer end is bent from one end of a small pin to resist against the vertical surface of the conductor element. Thereby, when the wall lamp is rotated through 360 degrees. The electric power is still supplied so as to achieve the object of omnidirectional adjustment.

BRIEF DESCRIPTION OF THE DRAWINGS

FIGS. 4-A to 4-H show one embodiment of the present invention, where the orientation of the wall lamp is changed according to the present invention.

DETAILED DESCRIPTION OF THE INVENTION

Figure 1:
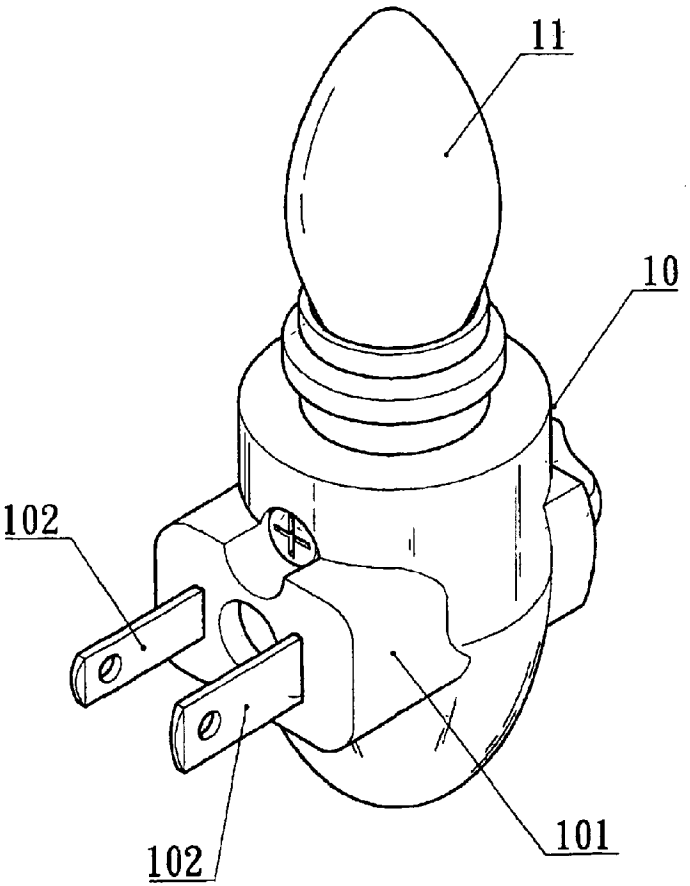
FIG 1 PRIOR ART
FIG. 1 is a perspective view of a conventional wall lamp plug.
Figure 2:
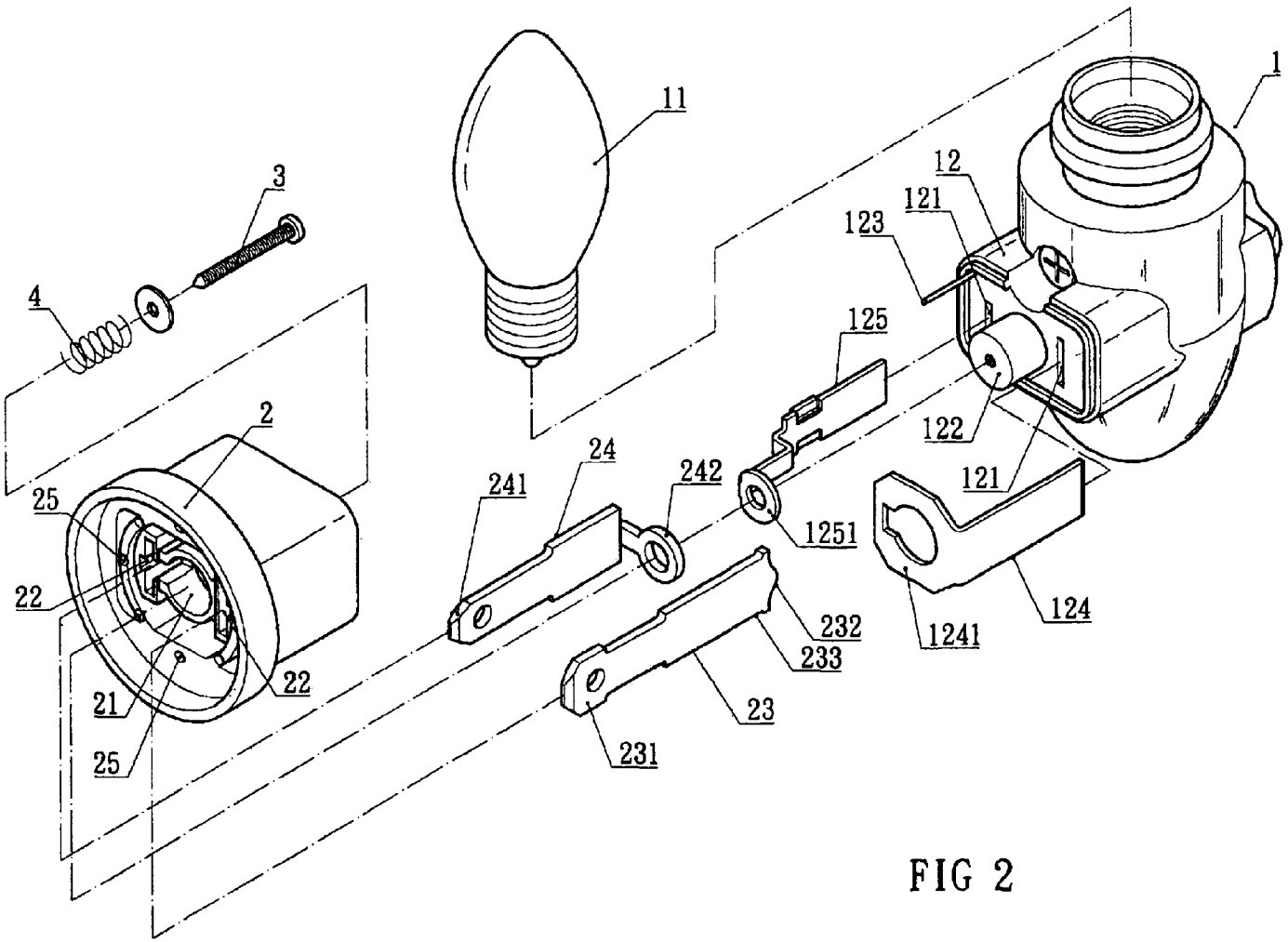
FIG. 2 is an exploded perspective view of the present invention.
Figure 3:
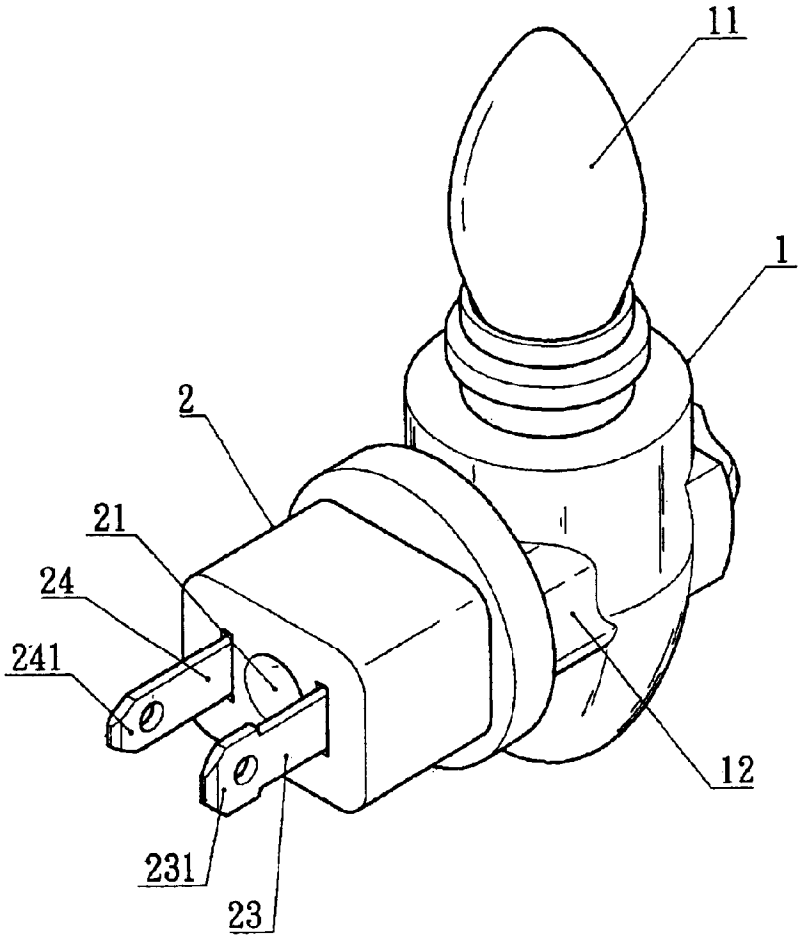
FIG. 3 is an assembled perspective view of the present invention.

Referring to FIG. 2 and FIG. 3, the present invention is comprised of a wall lamp body 1 having a light bulb 11 locked at a top thereof, a plug base 2 attached to the lateral end of the body 1, and a screw 3 and a spring 4 which fasten the body 1 to the plug base 2.

The body 1 has a start switch (not shown) at the lateral side thereof for turning on or off a power source. A press mount 12 with lead holes 121 protrudes from the other side of the body 1. A shaft 122 projects between the press mount 12 and the lead holes 121. A locating post 123 is disposed at each of the two opposite corners of the press mount 12. A conductor element 124 and a contact element 125 are respectively inserted through the lead holes 121 of the body 1.

The conductor element 124 is formed with a vertical surface 1241 having a through-hole therethorugh and is bent from a body of the conductor element. After the conductor element 124 is inserted into the lead hole 121, the vertical surface 1241 passes through the shaft 122 to resist against one side of the press mount 12.

The contact element 125 is formed with a vertical side 1251 having a through-hole therethrough. After the contact element 125 is inserted through the lead hole 121, the vertical side 1251 is adhered to the shaft 122.

The plug base 2 has a fastening hole 21 at it's a center thereof. A pin hole 22 is formed at each of the two sides of the fastening hole 21, and a large and a small pins 23 and 24 are respectively inserted into the pin holes 22. At the opposing ends where the plug base 2 is fastened to the body 1, a plurality of locating recesses 25 are arranged sequentially. Thereby, when the body 1 is rotated, the locating posts 123 are sequentially aligned with and are engaged to the locating recesses 25 of the plug base 2. Thus, the present invention can rotate through 360 degrees.

One end of the large pin 23 is an insertion end 231 and the other end thereof has a slight convex shape. This union end 232 resists against the vertical surface 1241 of the conductor element 124. Each of two sides of the union end 232 has a buckling edge 233. Thus, After the large pin 23 is inserted into one pin hole 22, the buckling edges 233 resists against the rear end of the pin hole 22, thereby enabling electrical connectivity between the body 1 and the plug base 2.

The small pin 24 has an insertion end 241 at one end thereof and a connection washer end 242 at another end thereof. The connection washer end 242 is formed by bending another end so as to resist against the vertical side 1251 of the contact element 125. After the small pin 24 is inserted into the pin hole 22, the connection washer end 242 resists against the inner side of the fastening hole 21.

Referring to FIG. 2, the screw 3 is firstly inserted through the spring 4 and into the fastening hole 21 of the plug base 2 and then installed to the shaft 122 of the body 1 so as to fasten the body 1 and the plug base 2 into a single structure. The plug base 2 and the body 1 are left a clearance therebetween so as not to wholly adhere to the body 1, thereby enabling the body 1 to rotate 360 degrees. Thereby, when the wall lamp is rotated, the union end 232 of the large pin 23 resists against the conductor element 124 of the body 1 and the connection washer end 242 of the small-ended pin 24 resists against the contact element 125 of the body 1. Thereby, the body 1 and the plug base 2 are conductive. The locating posts 123 of the body 1 are sequentially arranged and engaged into the locating recesses 25 of the plug base 2. Therefore, when the plug base 2 is inserted into the plug base on the wall, the body 1 rotates around the shaft 122 and is fixed at one position where locating posts 123 and locating recesses 25 engaged. The wall lamp of the present invention is capable of rotation through 360 degrees for omnidirectional adjustment to any desired angle. The start switch (not shown) is used to turn on or off the power source.

What is claimed is:

1. An omnidirectionally adjustable wall lamp plug comprising a wall lamp body locked with a bulb at a top end thereof, a press mount; a plug base attached to a lateral side of said body, and a screw and a spring fastening said body to said plug base; wherein said press mount has two lead holes; each of two opposite corners of said press mount are extended with a locating post, respectively; and a conductor element and a contact element are respectively inserted into said lead holes;

said plug base has a fastening hole and two pin holes; a large pin and a small pin are respectively inserted into said pin holes; said conductor element of said lamp body and a union end of said large pin are electric conductive; characterized in that:

said lamp body and said plug base are integrally formed; the plug base extends from the lamp body integrally; and said plug base encloses an outer periphery of the press mount.

2. The omnidirectionally adjustable wall lamp plug as claimed in claim 1, wherein said conductor element has a piece-like body and a vertical surface is extended from the piece-like body; the vertical surface has a through-hole; said vertical surface of said conductor element is inserted by a shaft at one side of said press mount; said contact element has bent with a vertical side having a through-hole; after said contact element is inserted into said pin hole; said vertical surface of said contact element resists against said shaft protruded from the press mount; said union end resists against said vertical surface of said conductor element, said union end having buckling edges along each of two sides of said union end; wherein after said buckling edges of said large pin are inserted into said plug base, the buckling edges resists against a rear end of said pin hole; and said union end of said large pin in said plug base resists against said vertical surface of said conductor element of said body and around the through hole and said connection washer end vertically extended from a body portion of said small pin resists against said vertical side of said contact element of said body; a hole is formed in the connection washer end; after said small pin is inserted said pin hole, said connection washer resists against an inner side of said fastening hole;

said plurality of locating recesses are arranged sequentially in the plug base which are capable being engaged to two of said locating recesses; when said body is pulled outwards; rotated to another position, and then pushed towards the plug body, said locating posts are engaged to another two of said locating recesses of said plug base.

* * * * *